US005267401A

United States Patent [19]

Freeman et al.

[11] Patent Number: 5,267,401

[45] Date of Patent: Dec. 7, 1993

[54] METHOD AND APPARATUS FOR GAUGING REEL DIAMETERS IN A REEL-TO-REEL SHEET MATERIAL TRANSPORT SYSTEM

[75] Inventors: Marvin L. Freeman, Round Rock; Charles D. Zinsmeyer, Austin, both of Tex.

[73] Assignee: Summagraphics Corporation, Seymour, Conn.

[21] Appl. No.: 920,117

[22] Filed: Jul. 24, 1992

[51] Int. Cl.[5] ..... G01B 5/08; G01B 5/10

[52] U.S. Cl. ..... 33/733; 33/754

[58] Field of Search ..... 33/733, 732, 734, 735, 33/744, 747, 754, 501.02

[56] References Cited

U.S. PATENT DOCUMENTS

| | | | |
|---|---|---|---|
| 473,103 | 4/1892 | Young | 33/733 |
| 1,985,228 | 12/1934 | Borroughs | 33/733 |
| 2,039,914 | 5/1936 | McBane | 33/732 |
| 2,656,756 | 10/1953 | Birr et al. | 33/732 |
| 2,852,195 | 9/1958 | Coleman et al. | 33/734 |
| 2,912,763 | 11/1959 | Loewe et al. | 33/733 |
| 3,158,938 | 12/1964 | Philipps et al. | 33/733 |
| 3,739,276 | 6/1973 | Dornberger | 33/732 |
| 4,565,007 | 1/1986 | Issenmann | 33/732 |
| 4,798,003 | 1/1989 | Haglöf | 33/734 |

*Primary Examiner*—William A. Cuchlinski, Jr.
*Assistant Examiner*—C. W. Fulton
*Attorney, Agent, or Firm*—Rosen, Dainow & Jacobs

[57] ABSTRACT

Method and apparatus are disclosed for determining the diameter of sheet material wound on a reel, and for setting the tension on sheet material as it is wound on the reel. According to one embodiment, the diameter of a take-up reel including sheet material wound thereon is determined from the angle of rotation or instantaneous angular speed of the take-up reel, and movement of the sheet material as obtained from rotation of a circular element such as a drive roller in a pinch roller drive system which rotates in proportional to sheet material movement. In another embodiment, the diameter of a reel in a reel-to-reel transport system is determined from the angles of rotation or instantaneous angular speeds of the supply and take-up reels, the total amount of sheet material in the system, and the packing factor of the sheet material rewound on the take-up reel. The diameter determination may then be used to set the torque of the drive motor for the take-up reel, and thereby the tension on the sheet material during winding.

23 Claims, 8 Drawing Sheets

METHOD AND APPARATUS FOR GAUGING REEL DIAMETERS IN A REEL-TO-REEL SHEET MATERIAL TRANSPORT SYSTEM

BACKGROUND OF THE INVENTION

The invention disclosed herein is directed to improvements in reel-to-reel sheet material transfer systems and methods, and more particularly to the determination of the diameter of one or both of the reels or spools (with sheet material wound thereon) in such systems. The sheet material may be in strip form such as ribbon, tape, film, etc. In the particular application disclosed herein, the sheet material is a thermal transfer or thermal donor medium moved past a thermal print head in a thermal printer, which transfers pigment, wax, resin, ink, etc. from the donor medium to a receptor medium such as paper.

In a transport system for transporting a sheet material from a supply reel thereof, past a station at which the sheet material is operated on (e.g., past a thermal print head in a thermal printer, or past a magnetic head which reads audio or video tapes) to a take-up reel on which the sheet material is rewound, it is desirable to apply a selected tension on the sheet material as it is moved past the station. The selected tension may be constant for a wide range of conditions, or different selected tensions may be applied in accordance for different conditions.

For example, thermal printers utilize a thermal transfer or donor medium (hereafter referred to as a "thermal transfer ribbon" or simply as "ribbon") containing pigment, wax, resin, ink, etc. (hereinafter referred to as "ink") which is transferred in a desired pattern to a receptor medium, e.g. paper, by a thermal print head. During printing, thermal elements in the print head contact the thermal transfer ribbon and press the ribbon against the receptor medium which is supported by a platen. By heat and some pressure the print head activates and transfers the ink carried by the ribbon (donor) onto the receptor medium. The ribbon and receptor medium are maintained in contact and heat is applied by the print head for a predetermined minimum "dwell" time sufficient to effect transfer of the ink to the receptor medium. Typically, the thermal transfer ribbon becomes temporarily adhered to the receptor medium during the dwell time as the ink is transferred thereto. The receptor medium is typically continuously moved past the print head at a rate slow enough to permit the print head to heat and press the ribbon against the receptor medium for at least the minimum required dwell time.

The tension imparted to the ribbon by a motor which drives the take-up reel, assisted by movement of the receptor medium with the ribbon pressed against it, unwinds ribbon from the supply reel and rewinds the ribbon on the take-up reel after the ribbon has passed adjacent the print head. Unused ribbon must be unwound from the supply reel, moved past the print head and rewound on the take-up reel at a rate which ensures that no used ribbon portion is adjacent the print head during printing, otherwise portions of the image to be printed will be skipped if there is coincidence between a used portion of the ribbon and the particular thermal elements in the print head that are activated during printing. At the same time, to conserve ribbon, the ribbon should not be unwound and rewound at such a high rate that unused ribbon is rewound on the take-up reel.

The tension on the ribbon also affects the drag on the receptor medium drive system, as well as movement of the ribbon past the print head. Proper tensioning of the ribbon reduces drag of the receptor medium on the drive system therefor, and also establishes the proper peel angle and donor/receptor dwell time. Stated another way, proper tensioning helps offset the braking effect caused by the print head bearing against the receptor medium.

Thus, it would be desirable in such an application to control the tension on the ribbon, and to be able to do so as operating parameters and conditions change, such as changes in the diameters of ribbon wound on the respective reels, changes in the type ribbon used, changes in the type receptor medium used, changes in the printing speed, etc. It is further desirable to accomplish such tension control continuously in real time. To accomplish such tension control, it may not only be necessary to adjust the drive torque to the take-up reel to maintain a constant tension on the ribbon, but also to adjust the torque to change the tension on the ribbon as operating parameters or conditions change.

Prior art mechanical arrangements are not entirely satisfactory for accomplishing sheet material tension control as described above. For example, relatively simple spring-loaded or counter-balanced tension control systems for reel-to-reel sheet material transport systems suffer from the drawback that they do not accurately control sheet material tension as operating conditions change and they often require direct contact of a sensor element with the media to be gauged, while other tension control systems that may be able to accomplish the tension control described above would be relatively complicated or expensive.

It is also desirable in reel-to-reel sheet material transport systems to determine the quantity of sheet material on the supply and take-up reels. For example, in the thermal printer described above, it would be helpful to determine when the transfer ribbon on the supply reel is about to be exhausted so that printing may be stopped before the ribbon runs out and a new reel may be loaded into position. Reel diameter determination is frequently performed by visual sighting, or by directly mechanically, electromechanically, or optoelectrically sensing the reel edge location. These techniques are either not accurate, require physical contact with the reel or ribbon, or are expensive to implement.

There is therefore a need for an improved sheet material tension control system and method, as well as for an improved sheet material diameter determining system and method.

OBJECTS AND SUMMARY OF THE INVENTION

It is object of the invention disclosed herein to control accurately the tension on sheet material in a reel-to-reel transport system in a relatively simple and inexpensive manner.

It is another object of the invention to control sheet material tension in a reel-to-reel system under Varying operating conditions.

It is another object of the invention to accurately move in a controlled manner sheet material from a supply reel past a station operating on the sheet material to a take-up reel after operation on the sheet material, and also to do so under varying operating conditions.

It is another object of the invention to determine accurately the diameter of sheet material wound on a reel in a relatively simple and inexpensive manner.

It is another object of the invention to control sheet material tension and determine sheet material diameter in reel-to-reel systems without physically contacting the sheet material on the supply and take-up reels.

It is another object of the invention to achieve the tension and sheet material control and advancement, and the diameter determination described in the above objects of the invention in real time and continuously.

The invention achieves various of the above and other objects by determining the diameter of the sheet material wound on a reel from measurements of the angle of rotation or angular speed of the reel and movement of the sheet material. For example, movement of the sheet material may be obtained from the angle of rotation or angular speed of a circular element which rotates according to a known relationship relative to the sheet material movement (or from angles of rotation and angular velocities respectively related thereto), and other known or deducible information.

According to a first embodiment, the other known or deducible information is the diameter of the circular element referred to above. In this embodiment the angles of rotation (or angular speeds) of the take-up reel and the circular element are measured, the diameter of the circular element is constant and known, and the diameter of the take-up reel is calculated from equation (1) below, assuming either that there is no slip between the sheet material and the circular element or that rotation of the circular element is related to movement of sheet material by a given relationship, e.g., linearly proportional, and that there is always tension on the sheet material:

$$d_t=(\theta_{cd}/\theta_t)d_{ce} \text{ or } d_t=(\omega_{ce}/\omega_t)d_{ce} \quad (1)$$

where $d_t$ is the instantaneous diameter of the take-up reel including sheet material wound thereon; $d_{ce}$ is the known constant diameter of the circular element; $\theta_{ce}$ is the angle of rotation of the circular element over a given time period; $\theta_t$ is the angle of rotation of the take-up reel for the given time period; $\omega_{ce}$ is the angular speed of the circular element; and $\omega_t$ is the angular speed of the take-up reel.

The circular element may engage and move another sheet material, and the sheet material being wound on the reel may be engaged and move with the other sheet material. For example, the other sheet material may be a receptor medium in a donor/receptor thermal printer, and the sheet material may be donor medium in the form of a thermal transfer ribbon which is engaged by the receptor medium via the thermal print head's pressing and heating the thermal transfer ribbon against the receptor medium.

The circular element may be part of a drive system which engages the sheet material and withdraws or assists in withdrawing it from the supply reel, or which engages and moves the other sheet material (e.g., the receptor medium). For example, the circular element may be a drive roller which forms part of a pinch roller drive system that engages and moves sheet material. In the preferred embodiment, the drive system moves a receptor sheet medium as described herein.

According to a second embodiment, the other known or deducible information is the total amount of sheet material in a reel-to-reel sheet material transport system as deduced from the initial diameter of the supply reel, the known core diameters of the supply and take-up reels and the packing factor of the sheet material rewound on the take-up reel. This embodiment does not assume that there is no slip between the sheet material and the circular element, or that there is always positive tension on the sheet material. In this embodiment the diameter of the take-up reel including the sheet material wound thereon is obtained from equation (2) below, where $d_t$ is the instantaneous diameter of the take-up reel; p is the packing factor (known); $d_{si}$ is the initial diameter of the supply reel With all of the sheet material wound thereon (known); $d_c$ is the reel core diameter; $\omega_t$ is the angular speed of the take-up reel (measured); and $\omega_s$ is the angular speed of the supply reel (measured):

$$d_t = 2\left[\frac{(1+p)^2 d_{si} + d_c^2}{4\left[1+(1+p)^2\left(\frac{\omega_t}{\omega_s}\right)^2\right]}\right]^{\frac{1}{2}} \quad (2)$$

For perfect repacking of the sheet material on the take-up reel (p=0), i.e., no diametrical growth over the initial packing of the sheet material on the supply reel as it is rewound on the take-up reel, or if the error introduced by non-perfect repacking of the sheet material on the take-up reel is ignored so that the diameter of the take-up reel is determined as an approximation (for example, accurate within about 5% to about 20%), equation (2) reduces to:

$$d_t = 2\left[\frac{d_{si} + d_c^2}{4\left[1+\left(\frac{\omega_t}{\omega_s}\right)^2\right]}\right]^{\frac{1}{2}} \quad (3)$$

A computing circuit, e.g. a microprocessor, microcomputer, microcontroller, logic and timing circuitry, etc., determines the reel diameter, and directly or through a motor control system accurately sets the desired tension in the sheet material by setting the take-up reel drive torque via the current to the drive motor for the take-up reel. (The motor current, which is set by the computing circuit, has a known relationship to the drive torque of the motor, which in turn determines the tension on the ribbon.) Determination of the diameter of the take-up reel as disclosed herein not only may be used to set the tension in the sheet material, but may be used additionally (or exclusively) to indicate the amount of sheet material remaining on the supply reel.

The invention permits the above to be accomplished continuously and in real time, on the fly at any point in the supply/take-up cycle, without prior initialization or return to a known "home" point, and without physically contacting the sheet material.

In determining the take-up reel diameter according to the first embodiment described above and equation (1); the torque of the motor driving the take-up reel must be set to some initial estimate. A short sample of the sheet material is then withdrawn from the supply reel and wound onto the take-up reel. During the transport of this short sample of the sheet material the computing circuit reads $\theta_{ce}$ and $\theta_f$ or $\omega_{ce}$ and $\omega_t$. Once this data has been taken, the computing circuit can then accurately set the motor torque and thereby the ribbon tension. For example, where the transport system is not operated continuously or where there are a plurality of sets of supply and take-up reels with one or more of the sets not being in use at the same time, an initial torque must be set when the transport system is initially used, or when, after a power down, it is initially used or reused, and after each reel change. Such initial torque is set without reference to actual conditions but rather to a value which would apply positive tension to the sheet material under all expected operating conditions so that the sheet material may be wound on the take-up reel. Since the initial tension on the sheet material may be such as to not permit the sheet material to be used or operated on as intended, the sheet material that is unwound with this initial tension may not be used and is instead wasted.

In accordance with a third embodiment of the invention, an initial tension is set using the second embodiment and equation (2) above, rather than setting the initial tension to a pre-set value, and then the tension determined with equation (2) is used to initially wind sheet material on the take-up reel, after which the tension is set according to the first embodiment and equation (1). This reduces the amount of sheet material that would otherwise be wasted if only equation (1) were used with an initial, pre-set tension.

BRIEF DESCRIPTION OF THE DRAWINGS

The invention disclosed herein is illustrated in the figures of the accompanying drawings which are meant to be exemplary and not limiting, in which like references refer to like or corresponding parts, and in which.

DESCRIPTION OF THE PREFERRED EMBODIMENTS

Figure 1:
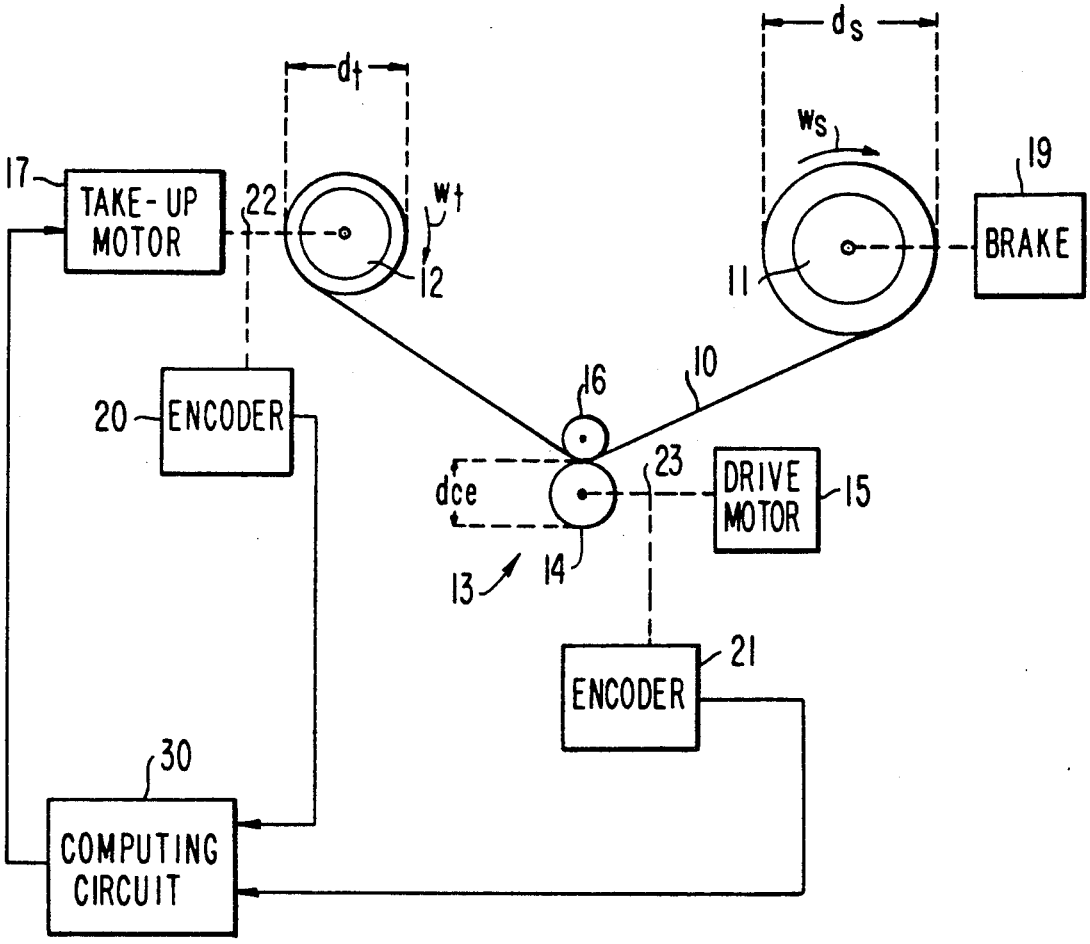
FIG. 1 is a simplified schematic and block diagram of a system in accordance with the first embodiment of the invention.

Referring to FIG. 1 of the drawings, sheet material in strip form, specifically a thermal transfer ribbon 10, is wound on and extends between a supply reel 11 and a take-up reel 12. Ribbon 10 is withdrawn from supply reel 11 by a conventional pinch roller drive system 13 comprising a drive roller 14 rotated by a motor 15 and a freely rotatable pinch roller 16. Ribbon 10 passing between drive roller 14 and pinch roller 16 is pressed therebetween so that rotation of drive roller 14 (the circular element described above) withdraws ribbon 10 from supply reel 11. A take-up motor 17 is coupled to apply torque to take-up reel 12, and thereby to apply tension to ribbon 10 during rewinding thereof on take-up reel 12 in order to ensure that the ribbon is properly wound on the take-up reel. Ribbon 10 may be withdrawn from supply reel 11 and wound on take-up reel 12 solely by the driving force of take-up motor 17 on take-up reel 12, or ribbon 10 may be withdrawn from supply reel 12 by the driving force of pinch roller drive system 13 alone, or by drive system 13 and take-up motor 17, and rewound on take-up reel 12 by the driving force of take-up motor 17. A brake 19 may be coupled to supply reel 11 in order to tension the ribbon as it is withdrawn from supply reel 11 by pinch roller drive system 13 and/or by take-up motor 17.

In some applications it is necessary to determine the diameter of the ribbon on take-up reel 12 and/or supply reel 11, and/or to accurately tension ribbon 10 as it is wound on take-up reel 12.

In accordance with the first embodiment of the invention, an encoder 20 is provided to monitor the angular rotation of take-up reel 12, and an encoder 21 is provided to monitor the angular rotation of drive roller 14. Encoders 20 and 21 are conventional and may be, for example, shaft encoders (e.g., optical, magnetic, etc.) coupled to the shafts 22 and 23 of take-up reel 12 and drive roller 14. The outputs of the encoders 20 and 21 are applied to a computing circuit 30.

In accordance with this embodiment of the invention, the outer diameter $d_t$ of ribbon 10 on take-up reel 12 is determined by computing circuit 30 according to equation (1) above, derived as follows. The length "x" of ribbon 10 withdrawn from supply reel 11 while engaged by pinch roller drive system 13 during a given time period is equal to the angle of rotation $\theta_{ce}$ of drive roller (circular element) 14 during that time period multiplied by the radius $r_{ce}$ ($d_{ce}/2$) of drive roller 14. Similarly, the length "x" of ribbon 10 wound on take-up reel 12 equals the angle of rotation $\theta_t$ of take-up reel 12 during that time period multiplied by the radius $r_t$ ($d_t/2$) of take-up reel 12. Assuming that no slip exists between ribbon 10 and drive roller 14 (or movement of ribbon 10 and drive roller 14 are related according to a given relationship), and that ribbon 10 as it is withdrawn from supply reel 11 does not go slack, i.e., there is always a positive tension on ribbon 10, the length "x" of ribbon withdrawn from supply reel 11 during the given time period is rewound on take-up reel 12, which yields equation (1) in terms of the respective angles of rotation. The instantaneous angular speeds $W_{ce}$ and $W_t$ of the drive roller 14 and take-up reel 12, respectively, may be used rather than the respective angles of rotation for the given time periods since $\theta = \omega/t$.

The known diameter $d_{ce}$ of drive roller 14 is loaded into computing circuit 30, and encoders 20 and 21 supply signals to computing circuit 30 representing the angles of rotation of take-up reel 12 and drive roller 14. Computing circuit 30 may be any appropriate conventional microprocessor, microcomputer, microcontroller or logic and timing circuitry, configured in known manner to compute $d_t$ according to equation (1).

As discussed above, the determination of the diameter of take-up reel 12 may be used to set the torque of take-up motor 17, thereby to accurately control the tension on ribbon 10 during rewinding thereof. Computing circuit 30 may be used to compute the desired tension from the diameter determination and from known relationships of torque and motor current and voltage.

Computing circuit 30 may provide an output dependent upon the instantaneous calculated diameter of take-up reel 12 either to a motor controller (not shown) for take-up motor 17 which provides the drive current to take-up motor 17, or directly to motor 17 as the drive current therefor to drive and control the torque of take-up motor 17, in order to maintain a desired tension on ribbon 10.

Figure 2:
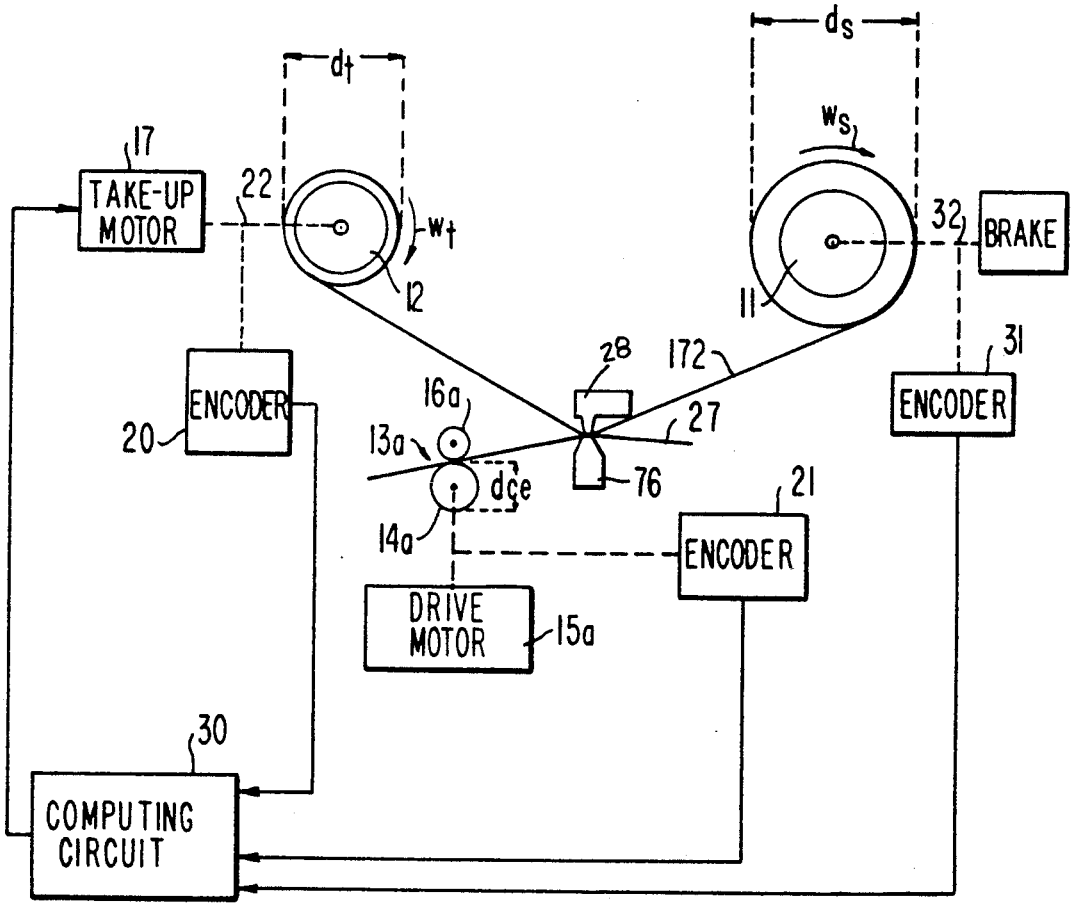
FIG. 2 is a simplified schematic and block diagram of a variation of the system of FIG. 1.

In the embodiment of the invention illustrated in FIG. 1, drive roller 14 drives ribbon 10 directly. FIG. 2 shows an embodiment which may be used to determine the diameter of take-up reel 12 or to set the torque of take-up motor 17 where the ribbon is driven indirectly by a drive system 13*a*. For example, drive system 13*a* may be mounted to directly drive another sheet material 27, such as a receptor medium (e.g., paper) in a donor/-receptor thermal transfer printer, with ribbon 172 being the donor medium and being driven indirectly by engaging contact thereof with the other sheet material 27. Such indirect driving of ribbon 172 assumes that there is no slip between the sheet material 27 and the ribbon, or that movement of ribbon 172, sheet material 27 and drive roller 14*a* are related according to a given relationship. Ribbon 172 and sheet material 27 are compressed between a print head 28 and a platen 76. Frictional forces between ribbon 172 and sheet material 27 prevent slipping when the torque of take-up motor 17 is at a proper level. Drive system 13*a* pulls sheet material 27, which moves ribbon 172 with it. Details of a printer 25 which employs the embodiment of FIG. 2 are described below. In that printer embodiment, an encoder 31 may be provided to monitor the angular rotation of supply reel 11, the purpose of which will be described below. Encoder 31 may be a shaft encoder as described above for encoder 20 but coupled to the shaft 32 of supply reel 11.

Figure 3:
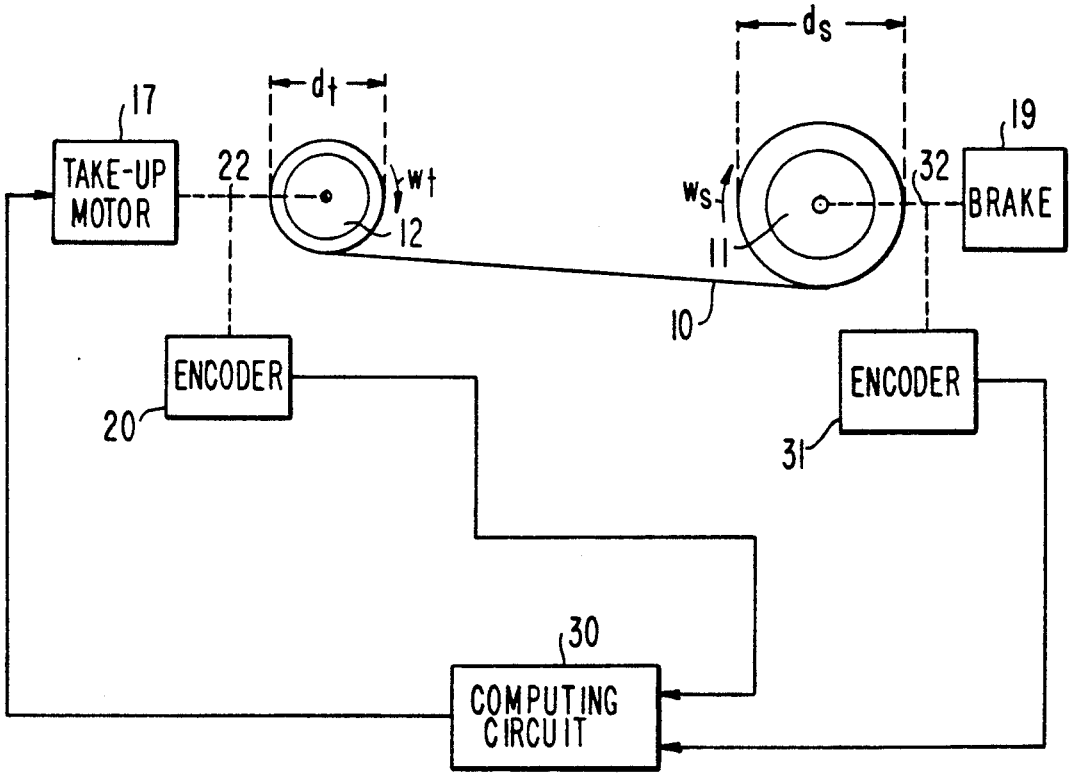
FIG. 3 is a simplified schematic and block diagram of a system in accordance with the second embodiment of the invention.

Referring to FIG. 3, in the second embodiment of the invention encoder 20 is provided to monitor the angle of rotation of take-up reel 12 as in the first embodiment of FIG. 1, and an encoder 31 is coupled to the shaft 32 of supply reel 11 to monitor the angle of rotation of supply reel 11. Take-up motor 17 withdraws ribbon 10 from supply reel 11 and rewinds it on take-up reel 12. The packing factor(p), the initial radius of supply spool 11 $r_s$ ($d_s/2$) and the core radii $r_c$ (or diameters) of the take-up and supply reels are loaded into computing circuit 30, and the outputs of the encoders 20 and 31 are applied to computing circuit 30, which computes the diameter $d_t$ of take-up reel 12 according to equation (2) above. The packing factor (p) is determined empirically. As indicated above, in this embodiment of the invention it is not necessary to assume that no slip exists between ribbon 10 and a drive roller 14 or another sheet material since the drive roller encoder 21 is not used and since slack conditions in the ribbon 10 spanning the supply reel 11 and the take-up reel 12 may be detected. If the output of encoder 20 indicates rotation when the output of encoder 31 indicates no rotation, a slack condition has occurred and may be detected by computing circuit 30.

The embodiment of FIG. 3 may, if desired, be used with a pinch roller drive system 13 or 13*a* which directly or indirectly unwinds ribbon from supply reel 11 as described above in connection with FIGS. 1 and 2.

Equation (2) above is derived as follows.

The instantaneous areas of the supply reel ($A_s$) and take up reel ($A_t$) (viewed as a circle from the side) are given by $$A_s=\pi(r_s^2-r_c^2) \tag{4}$$

$$A_t=\pi(r_t^2-r_c^2) \tag{5}$$

where $r_s$=the instantaneous radius of the supply reel, $r_c$=the radius of the core of the supply and take-up reels, and $r_t$=the instantaneous radius of the take-up reel.

The maximum area of the supply reel ($A_{smax}$) is given by:

$$A_{smax} = A_s + \frac{A_t}{(1+p)^2} = \pi(r_{si}^2 - r_c^2), \tag{6}$$

which is constant and known, and where p is the packing factor which is also known, and $r_{si}$ is the initial radius of the supply reel 11 which is known.

Similar to equation (1) above, $$\frac{r_t}{r_s} = \frac{\omega_s}{\omega_t}. \tag{7}$$

Solve for $A_t$ in equation (6), solve for $r_s$ in equation (7), then substitute the expression for $r_s$ into the expression for $A_t$, which gives $$r_t^2 = (1+p)^2\left[r_{si}^2 - \left(\frac{r_t\omega_t}{\omega_s}\right)^2\right] + r_c^2 \tag{8}$$

Solve equation (8) for $r_t$, substitute $d_t=2r_t$, which gives equation (2).

$$d_t = 2\left[\frac{(1+p)^2 d_{si} + d_c^2}{4\left[1+(1+p)^2\left(\frac{\omega_t}{\omega_s}\right)^2\right]}\right]^{\frac{1}{2}} \tag{2}$$

For perfect repacking of the sheet material onto the take-up reel, i.e., p=o: equation (2) reduces to equation (3) above.

$$d_t = 2\left[\frac{d_{si} + d_c^2}{4\left[1+\left(\frac{\omega_t}{\omega_s}\right)^2\right]}\right]^{\frac{1}{2}} \tag{3}$$

The embodiment of the invention described with reference to FIGS. 1 and 3 may be employed as stand-alone procedures for use in different applications to determine the diameter of the take-up reel and/or supply reel, and for setting the take-up reel torque. As mentioned above, the invention may employ the embodiments of both FIGS. 1 and 3 (and of FIGS. 2 and 3) together to set the torque of take-up motor 17. Initially the embodiment of FIG. 3 is used to formulate a highly accurate estimate of the diameter of the take-up reel without relying upon the assumptions that there is no slip between drive roller 14 and ribbon 10 (FIG. 1), or between the sheet material 27, ribbon 172 and drive roller 14a (FIG. 2) and that the ribbon may go slack anywhere between take-up reel 12 and supply reel 11. Then, the embodiment of FIG. 1 or FIG. 2 is used to determine exactly the diameter of the take-up reel while applying initial torque to the take-up reel as determined from the highly accurate initial estimate of the take-up reel diameter obtained from use of the embodiment of FIG. 3. For example, the procedure described in this paragraph may be used to set the tension of ribbon 10 during actual printing by a thermal printing apparatus in which ribbon 10 is pressed against the receptor medium by a thermal print head in its head down printing position while the receptor medium is moved past the print head by a pinch roller drive system. As indicated above, this eliminates the need to advance ribbon from the supply reel to the take-up reel in a non-printing mode of the printer, which results in waste of ribbon each time that a ribbon is changed, a new print started, upon initial power-up, etc.

Figure 5:
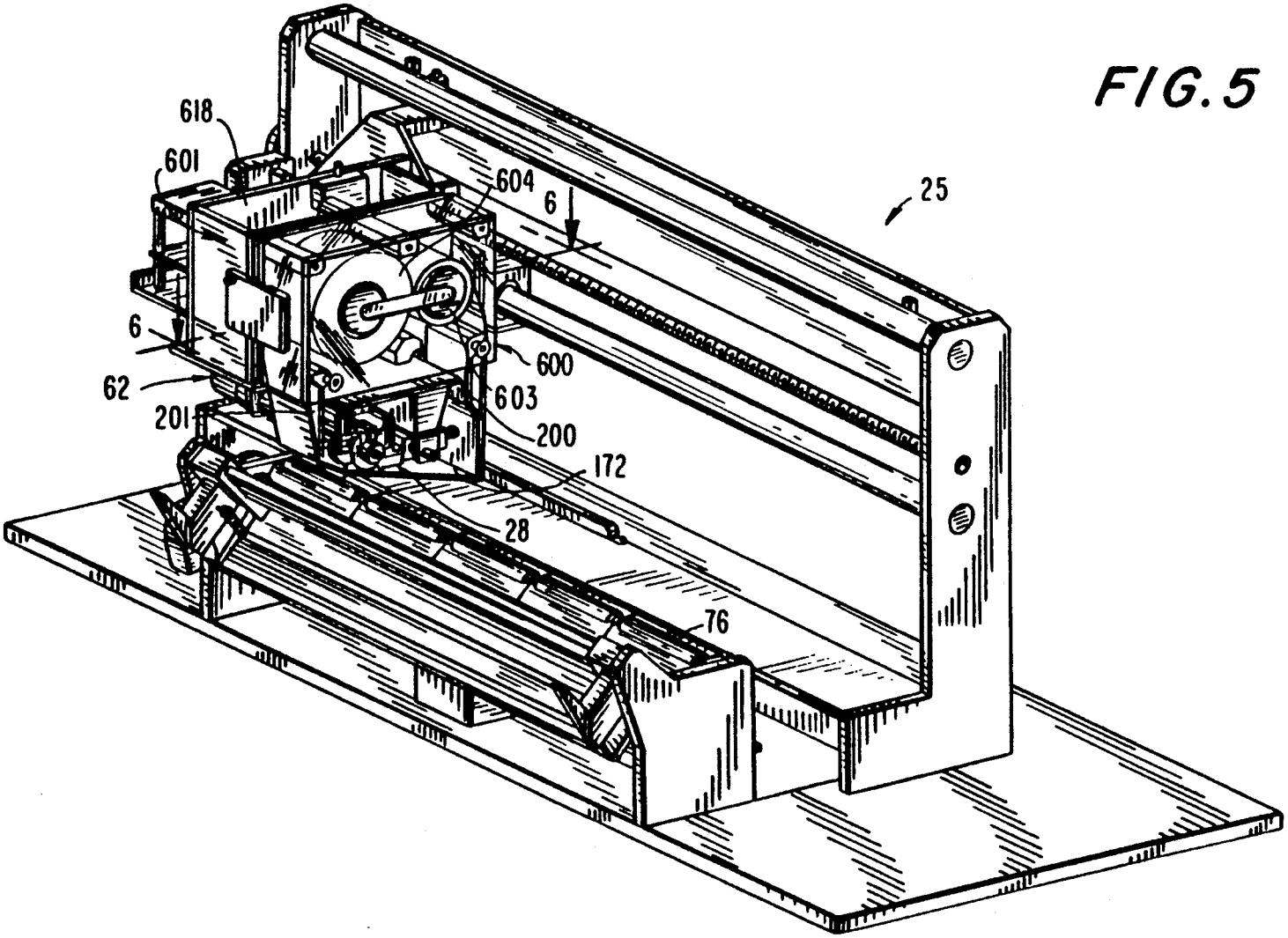
FIG. 5 is a perspective view, taken from a different direction from that of FIG. 4, of the thermal printer of FIG. 4, but without the cabinet and without the turret on the right side of the printer which stores cassettes of the thermal transfer ribbon.
Figure 6:
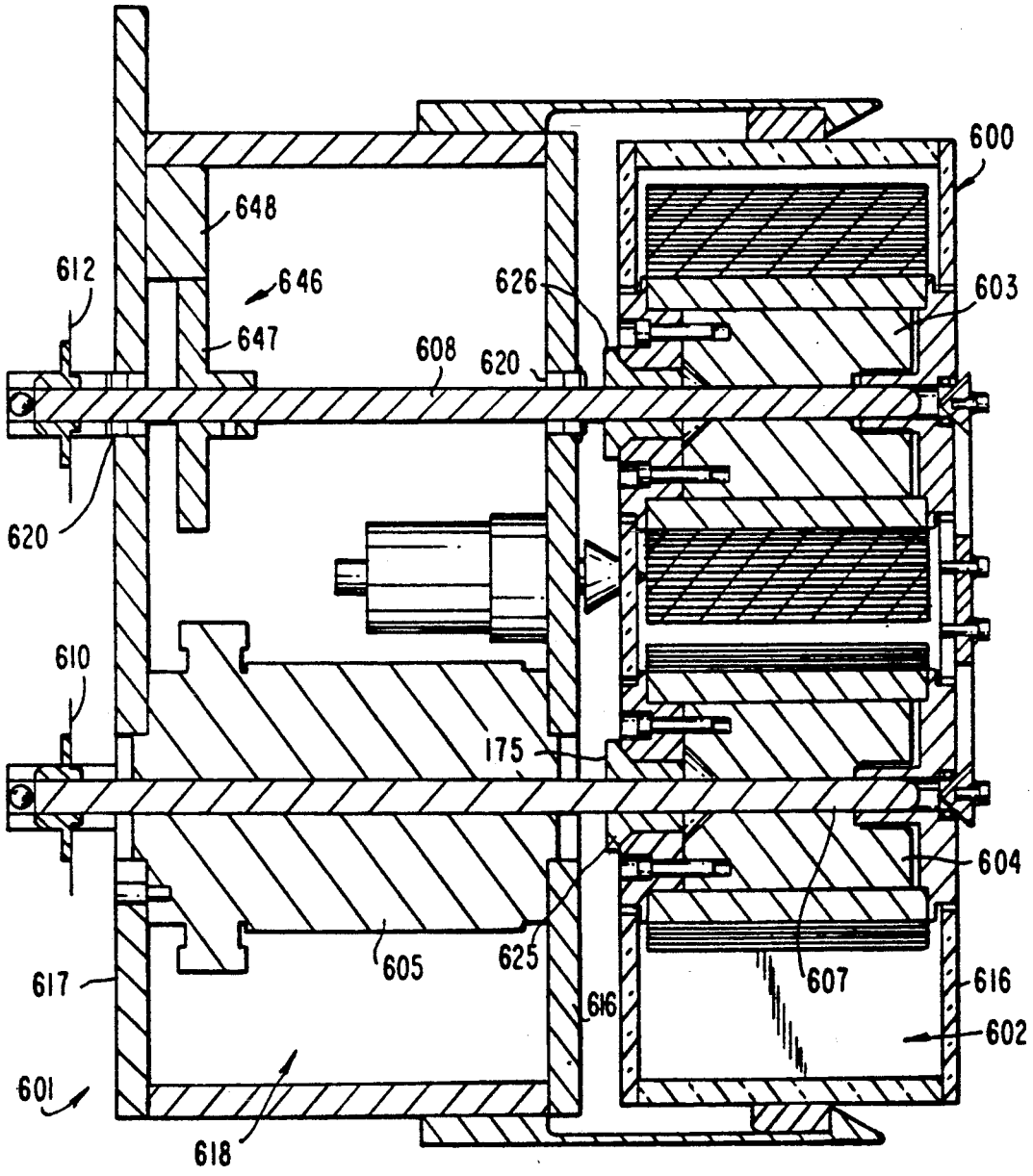
FIG. 6 is a cross sectional view of the transfer ribbon cassette and ribbon drive system of the apparatus of FIGS. 4 and 5 taken along line 6—6 of FIG. 5.
Figure 7:
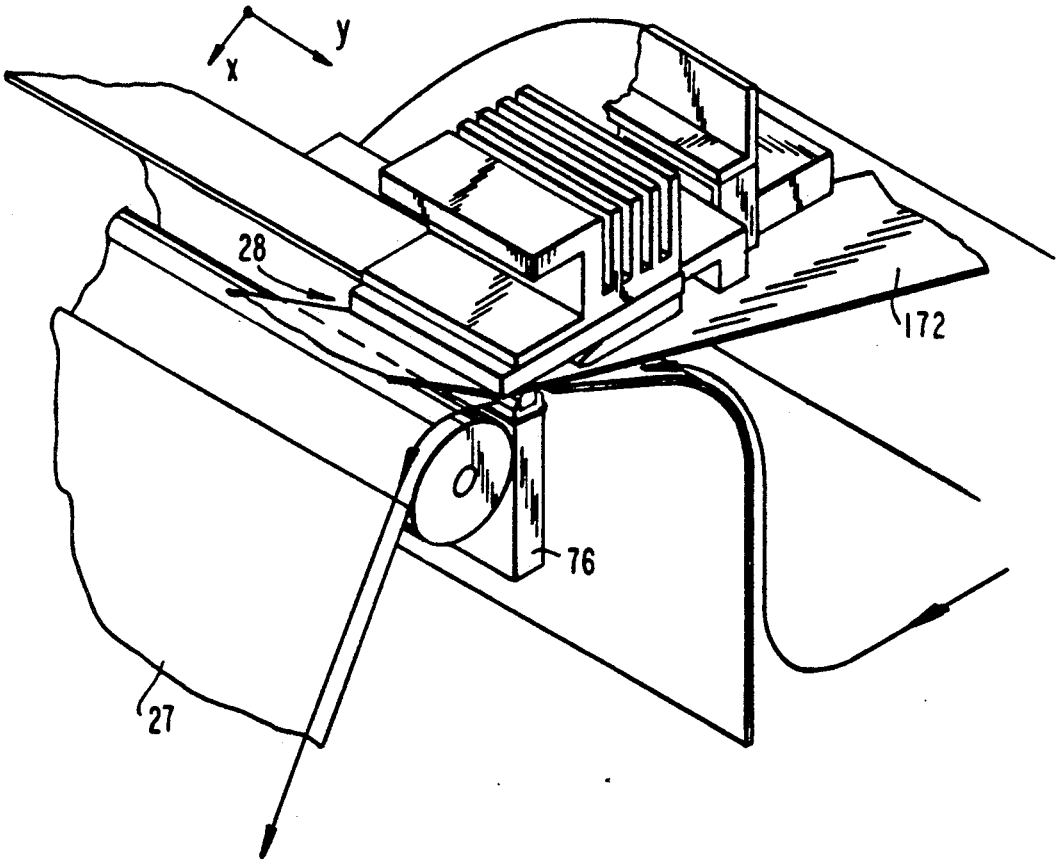
FIG. 7 is a perspective view of the thermal print head, the receptor medium, the platen and the transfer ribbon of the apparatus of FIGS. 4 and 5, with the transfer ribbon passing between the print head and the receptor medium.
Figure 8:
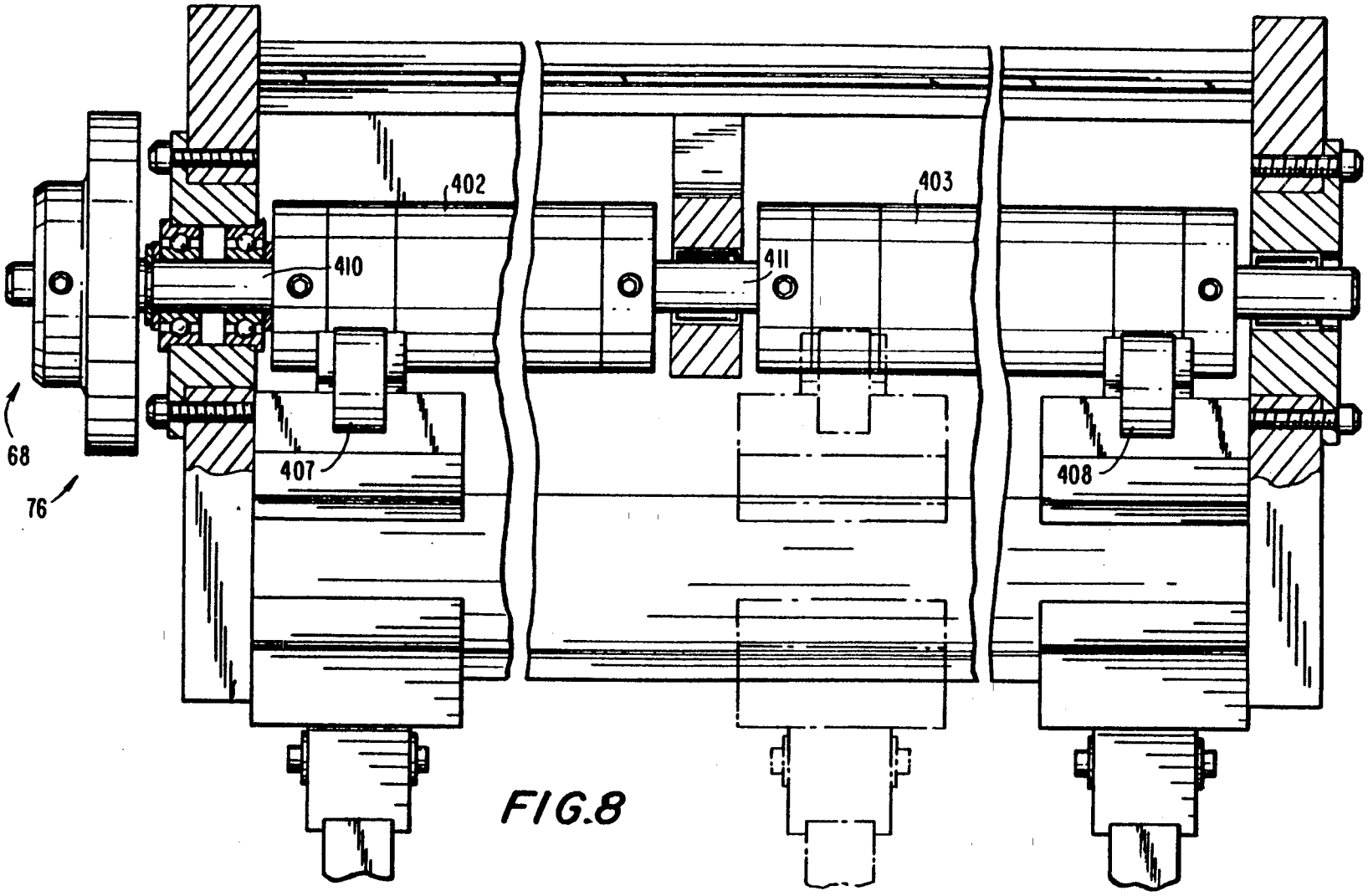
FIG. 8 is a cross sectional view of the receptor medium (paper) drive of the apparatus of FIGS. 4 and 5 taken along line 8—8 of FIG. 4.

The invention may be used for tension control and/or sheet material diameter determination in, among other devices, a donor/receptor thermal transfer printer 25 which is shown in part in FIGS. 4–8, and which is more fully described in copending U.S. patent application Ser. No. 07/920,186, filed on even date herewith, titled "Strip Mode Printing And Plotting Apparatus And Method", the disclosure of which is incorporated herein by reference. Only those details of printer 25 which are related to the invention disclosed herein and which assist in understanding the invention are described and shown. Printer 25 includes a thermal print head 28 (FIGS. 5 and 7) carried by a print carriage 62 over a platen 76. Referring to FIG. 7, a thermal donor medium in the form of thermal transfer ribbon 172 and a thermal receptor medium in the form of paper 27 are moved relative to print head 28 between the print head 28 and platen 76 while thermal elements in print head 28 are selectively heated to thermally transfer in desired patterns ink from ribbon 172 to paper 27. Each of the three embodiments described above may be employed by printer 25 to set the tension on ribbon 172 and/or to determine the amount of the ribbon wound on the supply and/or take-up reel.

Figure 4:
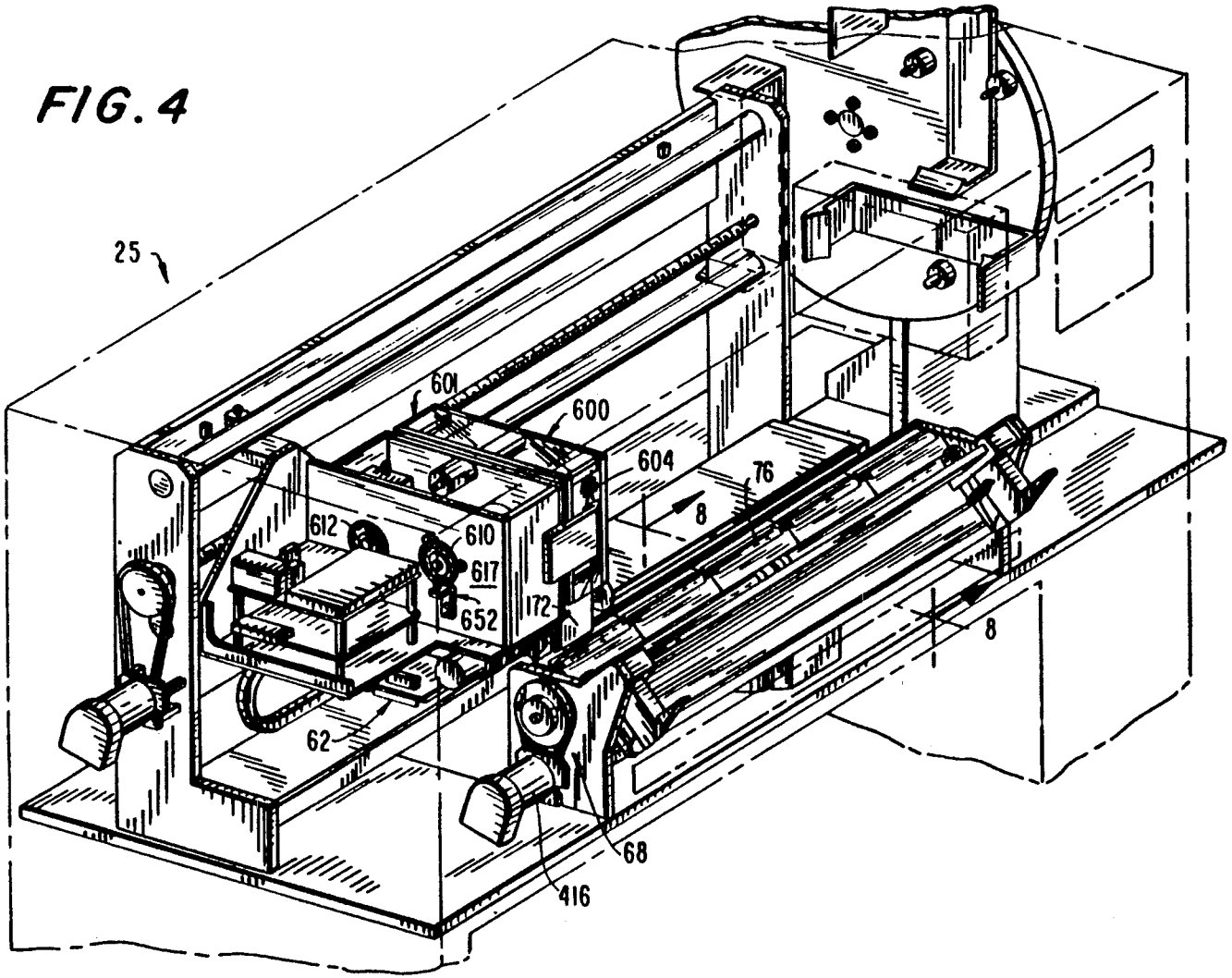
FIG. 4 is a perspective view of a thermal printer employing a tension control apparatus in accordance with the invention.

Referring to FIGS. 4–6, printer 25 includes a ribbon cassette 600 carrying thermal transfer ribbon 172, a ribbon supply reel 603 (FIGS. 5 and 6) and a take-up reel 604. Ribbon 172 is wound around supply reel 603 and extends to and is wound around take-up reel 604 with the ribbon passing adjacent print head 28. Cassette 600 is mounted to ribbon drive system 601, which is carried by print carriage 62 of printer 25. Ribbon drive system 601 in cooperation with movement of paper 27 unwinds ribbon 172 from supply reel 603 and rewinds it after thermal printing on take-up reel 604. Referring to FIG. 6, cassette 600 is removably mounted to ribbon drive housing 618 and is properly seated therein as described in application Serial No. 07/920,186.

Referring to FIG. 6, cassette 600 includes a housing 602 within which are rotatably mounted ribbon supply reel 603 and ribbon take-up reel 604. Ribbon drive system 601 comprises a take-up reel drive motor 605 having a shaft 607 (functioning as a take-up spindle) projecting from and rotated by motor 605, a supply spindle 608, and shaft encoder discs 610 and 612 attached to take-up spindle 607 and supply spindle 608, respectively. Shaft encoder disks 610 and 612 form part of sensors 652 (described below), only one of which is shown in FIG. 4. Drive motor 605 and spindle 608 are supported by opposed walls 616, 617 of a ribbon drive housing 618 which is mounted on carriage 62. Take-up spindle 607 projects from wall 616 a substantial distance sufficient to enter cassette housing 602 and be received in take-up reel 604, and also projects from opposite wall 617 a short distance sufficient to rotate the shaft encoder disc 610 mounted on the outside of the wall 617. Similarly, supply spindle 608 projects from opposite wall 616 a substantial distance sufficient to enter cassette housing 602 and be received in supply reel 603, and also projects from wall 617 a short distance sufficient to enable rotation of the cooperate with shaft encoder disc 612 mounted outside of the wall 617.

With continued reference to FIG. 6, the reels 603, 604 are mounted for rotation in cassette housing 602. A drive sprocket 625 is affixed to projecting take-up spindle 607 adjacent wall 616 to engage take-up reel 604 and thereby enable the motor 605 to rotate the take-up reel. A drive sprocket 626 is fixed to projecting supply spindle 608 adjacent wall 616 to engage supply reel 603 so that supply spindle 608 rotates with supply reel 603. Ribbon take-up reel 604 has a central recess at the end thereof toward the housing 618 for receiving the drive sprocket 625, and ribbon supply reel 603 has a central recess at the end thereof toward the housing 618 for receiving and engaging the sprocket 626. Rotation of take-up spindle 607 by motor 605 causes take-up reel 604 to rotate and wind ribbon thereon from supply reel 603 which rotates relatively freely under the braking action of a brake 646. Brake 646 may be comprised, for example, of a brake rotor 647 affixed to the shaft 608 and adapted to be engaged by a suitable brake pad 648 mounted to the housing 618.

Shaft encoder discs 610 and 612, (FIG. 6) form part of sensors 652 (only one of which is shown in FIG. 4), and are mounted for rotation with take-up spindle 607 and supply spindle 608, respectively. Sensors 652 are preferably of the optical type. Each disk 610, 612 comprises an opaque disc having holes therein or markings thereon, and sensors 652 may be conventional optical sensors which include a light emitting diode (not shown) and photo detector (not shown) mounted to opposed arms between which the respective disc 610, 612 is rotated.

The outputs of the sensors 652 are coupled to a printer controller (not shown herein, but shown and described in application Ser. No. 07/920,186, which performs the functions of computing circuit 30, and supplies the drive current to motor 605. Sensors 652 thus are an embodiment of encoders 20, 21 and 31 in FIGS. 1–3 and provide data to the printer controller concerning the angular displacement or speed of the respective shafts. That information enables the printer controller to determine the diameter of ribbon wound on supply reel 603 and take-up reel 604, and to determine therefrom the desired tension on the transfer ribbon according to the embodiments described above.

Referring to FIG. 5, transfer ribbon 172 from supply reel 603 is guided downwardly from the cassette 600 via a guide 200 connected to the cassette housing adjacent supply reel 603. Ribbon 172 is then directed under print head 28 (FIG. 7), and is guided upwardly to return to take-up reel 604 (FIG. 5) via a further guide 201 connected to the cassette housing adjacent take-up reel 604. Print head 28 is controlled to have a raised position (not shown) in which it does not apply heat and pressure to ribbon 172, and a lower position shown in FIG. 6 in which it engages ribbon 172 to force it downwardly toward a platen 76 and selectively apply heat thereto.

Referring to FIG. 6, paper 27 is positioned between the ribbon 172 and the platen 76, and printing thereon by thermal transfer is effected by print head 28 when it is in its lower position.

Referring to FIG. 7, during printing, thermal elements in print head 28 contact the thermal transfer ribbon 72 and press the ribbon against paper 27 which is supported by platen 76. By heat and some pressure for a predetermined minimum "dwell" time, print head 28 activates and transfers ink carried by ribbon 172 onto the paper 27 while paper 27 is continuously moved past print head 28. As discussed above, ribbon 172 becomes temporarily adhered to paper 27 during the dwell time as the ink is transferred thereto. Paper 27 is continuously moved by any conventional paper drive, or may be moved by paper drive 68 (FIG. 8) disclosed in Ser. No. 07/920,186. Paper 27 is moved past print head 28 at a rate slow enough to permit the print head to heat and press ribbon 172 against paper 27 for at least the minimum required dwell time. The tension imparted to ribbon 172 by motor 605 which drives the take-up reel 604 causes the used ribbon adjacent the print head to be peeled of the just printed paper 27 and be wound on the take-up reel, and such tension and the movement of paper 27 cause unused ribbon to be continuously unwound from the supply reel and moved into position adjacent (under) the print head. As indicated above, the tension on ribbon 172 is controlled so as to move a continuous supply of unused ribbon adjacent print head 28 while offsetting the braking effects or drag of print head 28 on paper 27.

The diameter determination embodiment of FIG. 3 may be carried out by printing apparatus 25 via the sensors 652 monitoring angular rotation or speed of the supply and take up reels; the packing factor; the reel core diameters; and the initial reel diameter which is input into the printer controller. The sensors 652 supply the respective angles of rotation of the initial supply and take-up reels to the printer controller, and the printer controller determines the diameter of the reels from equation (2).

The diameter determination embodiment of FIG. 1 may be carried out as follows. Paper 27 is advanced by pinch roller paper drive 68 (FIG. 4) which includes a drive motor 416 (FIG. 4) that rotates drive rollers 402, 403 (FIG. 8) via a drive shaft 410 connected to the left end of roller 402 and a common shaft 411 connecting rollers 402 and 403 to rotate together. Paper 27 passes between drive rollers 402, 403 and respective pinch rollers 407, 408 and is advanced by driving drive rollers 402, 403. Further details of paper drive 68 are disclosed in application Ser. No. 07/920,186 and in copending application Ser. No. 07/920,115 filed on even date herewith titled "Sheet Medium Transport System, Particularly For Printers And Plotters", the disclosure of which is incorporated herein by reference.

Since movement of ribbon 172 is related to movement of paper 27, and since movement of paper 27 is controlled by motor 300, i.e., is related to the angle of rotation of drive rollers 402, 403 (circular element), it is evident that a suitable encoder (e.g. encoder 21 in FIG. 2) may be provided on the shaft of motor 300, or on shaft 410 of drive rollers 402, 403, and connected to the printer controller to provide the angle of rotation of the circular element or drive roller of the FIG. 2 embodiment. The printer controller then determines the diameter of the reels of the cassette 600 in accordance with equation 1 and the embodiment of the invention illustrated in FIG. 2.

The printer controller calculates the torque to be developed by take-up reel drive motor 605 to maintain accurate take-up tension on ribbon 172 in dependence upon the ribbon diameters determined as described above. Additionally, the printer controller tracks actual transfer ribbon use and determines when transfer ribbon replenishment is necessary.

As indicated above, the angular speed of the reels or the angular displacement may be measured. Accordingly, the computing circuit and printer controller may be constructed and/or programmed to respond to angular speed or angular displacement.

The method and apparatus of the invention thus enable the continuous real time determination of the diameters of the material on the supply and take-up reels, without the necessity of prior initialization or returning to a known "home" point. The invention thus provides the data from any random time in the supply/take-up cycle, and does not require contact by some mechanical measuring element with the transported sheet material.

While the invention has been disclosed and described with reference to certain embodiments, it will be apparent that variations and modifications may be made therein. Also, while use of the invention has been described in connection with a donor/receptor thermal transfer printing apparatus, the invention may be used in other applications, such as reel-to-reel transport systems as may be found in audio and video tape recorders and players, data storage tape systems, etc. It is therefore intended in the following claims to cover such variations, modifications and uses as fall within the spirit and scope of the invention.

What is claimed is:

1. In a reel to reel sheet material transport system which includes a supply reel and a take-up reel, a method for determining the diameter of sheet material being wound on the take-up reel, there being a circular element upstream of the take-up reel which rotates in a given relationship relative to movement of the sheet material towards the take-up reel, the circular element having a diameter, the sheet material being wound on the take-up reel at a rate in a given relationship relative to rotation of the circular element, the method comprising:

measuring the angle of rotation of the take-up reel during a given time period;

measuring the angle of rotation of the circular element during the given time period; and computing the diameter of the take-up reel including sheet material wound thereon from the ratio of the measured angles of rotation of the circular element and of the take-up reel multiplied by the diameter of the circular element.

2. A method for setting a predetermined tension on sheet material as the sheet material is wound on a reel by rotation of the reel by a motor, there being a circular element upstream of the reel which rotates in a given relationship relative to movement of the sheet material towards the reel, the method comprising:

determining the diameter of the sheet material being wound on the reel including the diameter of a core of the reel around which the sheet material is wound from a ratio of the angles of rotation of the circular element and of the reel multiplied by the diameter of the circular element, correlating diameters of the reel with motor drive currents required by the motor to rotate the reel with a desired tension or with respective desired tensions on the sheet material, and setting the drive current to the motor to one which corresponds to the determined diameter of the reel.

3. The method of claim 1 or 2 wherein sheet material is moved towards the reel by a drive system which includes the circular element, the method including the step of moving the sheet material by engaging the circular element with the sheet material without slip between the sheet material and the circular element, and winding the sheet material on the reel at the same rate that the sheet material is moved by the circular element.

4. The method of claim 1 or 2 wherein the sheet material is moved towards the reel by a drive system which includes the circular element, the method including the step of moving other sheet material by engaging the circular element with the other sheet material without slip between the other sheet material and the circular element, engaging the sheet material to be wound on the reel with the other sheet material without slip between the two sheet materials and so that movement of the other sheet material by the circular element moves the sheet material towards the reel, and winding the sheet material on the reel at the same rate that the sheet material is moved with the other sheet material.

5. The method of claim 1 or 2 wherein the circular element is a roller and wherein the drive system comprises another roller, the step of moving the other sheet material comprising engaging the other sheet material between the rollers and driving at least one of the rollers.

6. In a reel to reel sheet material transport system which includes a supply reel and a take-up reel, a method for determining the diameter of sheet material being wound on the take-up reel, the sheet material extending between the supply reel and the take-up reel and being unwound from the supply reel and wound on the take-up reel, the method comprising:

measuring the angle of rotation of the supply reel during a given time period;

measuring the angle of rotation of the take-up reel during the given time period; and computing the diameter of the take-up reel including sheet material wound thereon from the measured angles of rotation of the supply reel and the take-up reel and the total quantity of sheet material wound on and extending between the supply reel and the take-up reel.

7. A method for setting a predetermined tension on sheet material as the sheet material is wound on a take-up reel by rotation of the take-up reel by a motor, the sheet material extending between a supply reel and the take-up reel and being unwound from the supply reel and wound on the take-up reel, the method comprising:

determining the diameter of the sheet material being wound on the take-up reel including the diameter of a core of the take-up reel around which the sheet material is wound from angles of rotation of the supply reel and the take-up reel and the total quantity of sheet material wound on and extending between the supply reel and the take-up reel;

correlating diameters of the take-up reel with motor drive currents required by the motor to rotate the take-up reel with a desired tension or with desired respective tensions on the sheet material;

and setting the drive current to the motor which corresponds to the determined diameter of the take-up reel.

8. The method of claim 6 or 7 wherein the computing step includes computing the diameter of the take-up reel also from the packing factor of the sheet material wound on the take-up reel.

9. The method of claim 6 or 7 wherein the computing step computes the diameter of the take-up reel from the following equation:

$$d_t = 2\left[\frac{(1+p)^2 d_{si} + d_c^2}{4\left[1 + (1+p)^2\left(\frac{\omega_t}{\omega_s}\right)^2\right]}\right]^{\frac{1}{2}}.$$

10. The method of claim 9 wherein the computing step sets the packing factor p equal to zero, and computes the diameter of the take-up reel from the following equation:

$$d_t = 2\left[\frac{d_{si} + d_c^2}{4\left[1 + \left(\frac{\omega_t}{\omega_s}\right)^2\right]}\right]^{\frac{1}{2}}.$$

11. A method for setting a predetermined tension on sheet material as the sheet material is wound on a take-up reel by rotation of the take-up reel by a motor, the sheet material extending between a supply reel and the take-up reel and being unwound from the supply reel and wound on the take-up reel, there being a circular element upstream of the take-up reel which rotates in proportion to movement of the sheet material towards the take-up reel, the method comprising:

determining the initial diameter of the sheet material being wound on the take-up reel including the diameter of a core of the take-up reel around which the sheet material is wound from angles of rotation of the supply reel and the take-up reel and the total quantity of sheet material wound on and extending between the supply reel and the take-up reel;

correlating diameters of the take-up reel with motor drive currents required by the motor to rotate the take-up reel with a desired tension or with desired respective tensions on the sheet material;

setting the initial drive current to the motor which corresponds to the initial determined diameter of the take-up reel;

winding sheet material on the take-up reel while applying the initial tension; and thereafter determining again with the initial tension applied to the sheet material the diameter of the sheet material being wound on the reel including the diameter of a core of the reel around which the sheet material is wound from a ratio of the angles of rotation of the circular element and of the take-up reel multiplied by the diameter of the circular element, and setting the drive current to the electric motor which corresponds to the most recent determined diameter of the take-up reel.

12. In a reel to reel sheet material transport system which includes a supply reel and a take-up reel, apparatus for determining the diameter of sheet material being wound on the take-up reel, comprising:

a circular element upstream of the take-up reel coupled to rotate in a given relationship relative to movement of the sheet material towards the take-up reel, said circular element having a diameter;

means for winding the sheet material on the take-up reel at a rate in a given relationship relative to rotation of said circular element;

means for measuring the angle of rotation of the take-up reel during a given time period;

means for measuring the angle of rotation of said circular element during the given time period; and means for computing the diameter of the take-up reel including sheet material wound thereon from the ratio of the measured angles of rotation of said circular element and of the reel multiplied by the diameter of said circular element.

13. The apparatus of claim 12 comprising a drive system for moving the sheet media toward the reel, said drive system including said circular element, said circular element engaging the sheet material to move it towards the reel without slip between the sheet material and said circular element, said means for winding the sheet material on the reel comprising an electric motor coupled to rotate the reel and apply tension to the sheet material to wind the sheet material thereon at the same rate that the sheet material is moved with said circular element.

14. The apparatus of claim 12 comprising a drive system for moving the sheet material toward the reel, said drive system including said circular element, said circular element engaging other sheet material to move the other sheet material without slip between the other sheet material and said circular element, means causing the sheet material to be engaged by the other sheet material and moved by the other sheet material towards the reel without slip between the two sheet materials, said means for winding the sheet material on the reel comprising an electric motor coupled to rotate the reel and apply tension to the sheet material to wind the sheet material thereon at the same rate that the other sheet material is moved with said circular element.

15. Apparatus for setting a predetermined tension on sheet material as the sheet material is wound on a reel, comprising:

a motor coupled to the reel to rotate the reel so as to wind sheet material thereon;

a circular element upstream of the reel coupled to rotate in a given relationship relative to movement of the sheet material towards the reel, said circular element having a diameter;

means for measuring the angle of rotation of the reel during a given time period;

means for measuring the angle of rotation of said circular element during the given time period; and means for computing the diameter of the sheet material being wound on the reel including the diameter of a core of the reel around which the sheet material is wound from a ratio of the angles of rotation of the circular element and of the reel multiplied by the diameter of the circular element;

means for correlating diameters of the reel with drive currents of said motor required by said motor to rotate the reel with a desired tension or with desired respective tensions on the sheet material; and means for setting the drive current to said motor which corresponds to the determined diameter of the reel.

16. The apparatus of claim 15 comprising a drive system for moving the sheet material toward the reel, said drive system including said circular element, said circular element engaging the sheet material to move it towards the reel without slip between the sheet material and said circular element, said electric motor being coupled to rotate the reel to wind the sheet material thereon at the same rate that the sheet material is moved by said circular element.

17. The apparatus of claim 15 comprising a drive system for moving the sheet material toward the reel, said drive system including said circular element, said circular element engaging other sheet material to move the other sheet material without slip between the other sheet material and said circular element, means causing the sheet material to be engaged by the other sheet material and moved by the other sheet material towards the reel without slip between the two sheet materials, said motor for winding the sheet material on the reel being coupled to rotate the reel to wind the sheet material thereon at the same rate that the other sheet material is moved by said circular element.

18. In a reel to reel sheet material transport system which includes a supply reel and a take-up reel, apparatus for determining the diameter of sheet material being wound on the take-up reel, the sheet material extending between the supply reel and the take-up reel and being unwound from the supply reel and wound on the take-up reel, the apparatus comprising:

means for measuring the angle of rotation of the take-up reel during a given time period;

means for measuring the angle of rotation of the supply reel during the given time period; and means for computing the diameter of the take-up reel including sheet material wound thereon from the measured angles of rotation of the supply reel and the take-up reel and the total quantity of sheet material wound on and extending between the supply reel and the take-up reel.

19. Apparatus for setting a predetermined tension on a sheet material as the sheet material is wound on a take-up reel, the sheet material extending between a supply reel and the take-up reel and being unwound from the supply reel and wound on the take-up reel, the apparatus comprising:

an electric motor coupled to the take-up reel to rotate the take-up reel so as to wind sheet material thereon;

means for measuring the angle of rotation of the take-up reel during a given time period;

means for measuring the angle of rotation of the supply reel during the given time period; and means for computing the diameter of the sheet material being wound on the reel including the diameter of a core of the reel around which the sheet material is wound from angles of rotation of the supply reel and the take-up reel and the total quantity of sheet material wound on and extending between the supply reel and the take-up reel;

means for correlating diameters of the reel with drive currents of said motor required by said motor to rotate the reel with a desired tension or with desired respective tensions on the sheet material; and setting the drive current to said electric motor which corresponds to the determined diameter of the reel.

20. The apparatus of claim 18 or 19 wherein the computing means computes the diameter of the take-up reel also from the packing factor of the sheet material wound on the take-up reel.

21. The apparatus of claim 18 or 19 wherein said computing means computes the diameter of the take-up reel from the following equation:

$$d_t = 2\left[\frac{(1+p)^2 d_{si} + d_c^2}{4\left[1 + (1+p)^2\left(\frac{\omega_t}{\omega_s}\right)^2\right]}\right]^{\frac{1}{2}}.$$

22. The apparatus of claim 20 wherein the packing factor p is set equal to zero and said computing means computes the diameter of the take-up reel from the following equation:

$$d_t = 2\left[\frac{d_{si} + d_c^2}{4\left[1 + \left(\frac{\omega_t}{\omega_s}\right)^2\right]}\right]^{\frac{1}{2}}.$$

23. Apparatus for setting a predetermined tension on sheet material as the sheet material is wound on a take-up reel, the sheet material extending between a supply reel and the take-up reel and being unwound from the supply reel and wound on the take-up reel, the apparatus comprising:

a circular element upstream of the take-up reel which rotates in proportion to movement of the sheet material towards the take-up reel;

a motor coupled to the take-up reel to rotate the take-up reel so as to wind sheet material thereon;

means for measuring the angle of rotation of the take-up reel during a given time period;

means for measuring the angle of rotation of the supply reel during the given time period;

means for initially computing the diameter of the sheet material being wound on the take-up reel including the diameter of a core of the take-up reel around which the sheet material is wound from angles of rotation of the supply reel and the take-up reel and the total quantity of sheet material wound on and extending between the supply reel and the take-up reel;

means for correlating diameters of the take-up reel with motor drive currents required by said motor to rotate the take-up reel with a desired tension or with desired respective tensions on the sheet material; and means for setting the initial drive current to the motor which corresponds to the initial determined diameter of the take-up reel;

said computing means determining again with the initial tension applied to the sheet material the diameter of the sheet material being wound on the take-up reel including the diameter of the core of the take-up reel around which the sheet material is wound from a ratio of the angles of rotation of the circular element and of the take-up reel multiplied by the diameter of the circular element;

said setting means setting the drive current to said motor which corresponds to the most recent determined diameter of the take-up reel.

* * * * *